United States Patent [19]

Hewitt

[11] 4,324,190

[45] Apr. 13, 1982

[54] PALLET AND METHOD OF LOADING VEHICLES UTILIZING SAME

[75] Inventor: Norman S. Hewitt, Chicago, Ill.

[73] Assignee: The Continental Group, Inc., Stamford, Conn.

[21] Appl. No.: 138,398

[22] Filed: Apr. 8, 1980

[51] Int. Cl.[3] ..... B65D 19/24

[52] U.S. Cl. ..... 108/51.1; 108/53.3; 108/91; 410/42; 414/63

[58] Field of Search ..... 108/55.3, 55.1, 55.5, 108/53.1, 53.3, 51.1, 91; 206/386, 504; 220/23.4, 23.6; 414/63, 59; 410/140, 141, 156, 30-32, 36, 42, 47

[56] References Cited

U.S. PATENT DOCUMENTS

| | | | |
|---|---|---|---|
| 1,218,814 | 3/1917 | Steinmetz . | |
| 1,618,325 | 2/1927 | Chalmers . | |
| 2,745,588 | 5/1956 | Dunning . | |
| 2,816,652 | 12/1957 | Clark . | |
| 2,974,841 | 3/1961 | Van Leer . | |
| 3,059,825 | 10/1962 | Thomas . | |
| 3,196,229 | 7/1965 | Glass . | |
| 3,308,771 | 3/1967 | Wettlen | 108/51.1 |
| 3,596,781 | 8/1971 | Burton | 410/42 |
| 3,710,732 | 1/1973 | Phelps | 108/51.1 |
| 3,746,178 | 7/1973 | Wasschal . | |
| 3,834,323 | 9/1974 | Weinmann | 108/51.1 |
| 3,872,975 | 3/1975 | Silver . | |
| 4,061,391 | 12/1977 | Violette | 410/36 X |

FOREIGN PATENT DOCUMENTS

| | | | |
|---|---|---|---|
| 1552705 | 9/1979 | United Kingdom | 206/386 |

*Primary Examiner*—William E. Lyddane
*Attorney, Agent, or Firm*—Charles E. Brown

[57] ABSTRACT

This relates to the storage of drums and like cylindrical objects in a vehicle body for shipment. More specifically, it has to do with the provision of a pallet which has the opposite ends thereof notched in a complementary manner so that cylindrical objects may be packed thereon in columns wherein transversely adjacent cylindrical objects are longitudinally offset and cylindrical objects of adjacent columns are internested.

9 Claims, 4 Drawing Figures

PALLET AND METHOD OF LOADING VEHICLES UTILIZING SAME

This invention relates to the loading and transshipment of cylindrical objects such as cans, drums, spools, reels and the like, of a relatively large diameter, and more particularly to a pallet for accommodating the cylindrical objects arranged in parallel transversely internested rows.

It is well known that when cylindrical articles are packed or stored in neat rows and columns, the number of such articles which may be stored in a given space is much less than that if the articles are permitted to internest with one another.

Cylindrical articles such as large cans, drums, spools, rolls and the like, are conventionally loaded on pallets and then, while so loaded, placed in a vehicle for transshipment. Conventionally the pallets are either square or rectangular and the cylindrical objects are packed thereon in orderly rows and columns. To do otherwise with a rectangular pallet would result in a lesser number of objects being accommodated by a given size pallet.

In accordance with this invention, it is proposed to make use of the well known advantage of the ability to store a larger number of cylindrical objects in internested relation than when arranged in rows and columns when the storage space is relatively large while at the same time employing pallets for holding such cylindrical objects for ease of handling.

In accordance with this invention, pallets are provided with the upper ends thereof, instead of being parallel, being defined by a plurality of straight edges which are transversely alternated and longitudinally offset with there being a straight edge for each row of cylindrical articles. This notched or toothed arrangement of the ends of the pallet permits the cylindrical objects in adjacent rows to be longitudinally offset, preferably one-half the diameter of the object, and internested.

It is further proposed that each such pallet have a width which is equal to one divided by an even number times the available width of the vehicle so that the pallets will occupy the full floor area of the vehicle. If desired and feasible from a handling standpoint, each pallet may be of a width equal to the internal width of the vehicle into which the cylindrical objects are to be loaded.

A further feature of the invention is to provide a terminal pallet wherein only one end of the pallet is of a notched configuration, the other end of the pallet having a straight line edge. Normally this pallet will be a terminal pallet and is used in the forward end of the vehicle, particularly when the vehicle is in the form of a truck body or trailer body.

The notched edges of the opposite ends of a pallet will be complementary so that adjacent pallets may be disposed in interlocking relation with the cylindrical objects stacked thereon being in substantially touching relation as between objects of adjacent pallets.

More importantly, this invention relates to the utilization of pallets having notched ends for the loading of vehicles with a maximum number of cylindrical objects.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
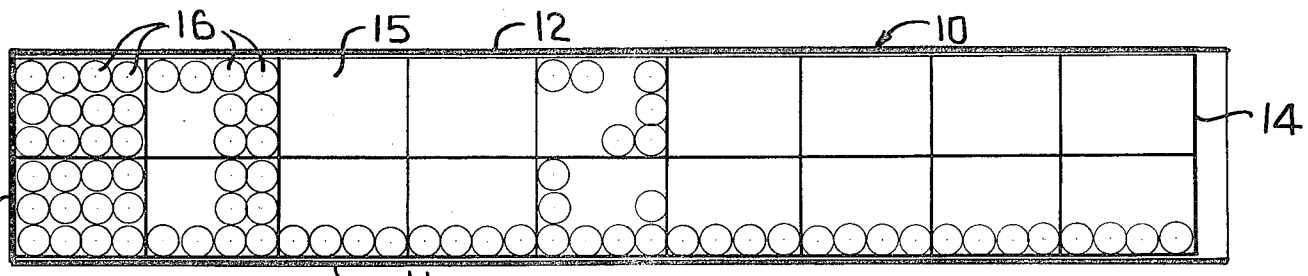
FIG. 1 (PRIOR ART)
FIG. 1 is a schematic plan view showing the conventional manner of packing drums loaded on pallets inside of a conventional trailer.

Referring now to the drawings in detail, FIG. 1 illustrates the manner in which drums or other cylindrical objects are conventionally packed inside of a trailer. The illustrated trailer is generally identified by the numeral 10 and has sides 11, 12, a closed forward end 13, and an open rear 14 normally closed by doors (not shown). The trailer 10, which is of a conventional size, will have an inside width of 7 feet, 8½ and an inside length of 44 feet, 6 inches. The trailer has seated therein eighteen like pallets 15 each of which is of a plan dimension 44 inches by 58 inches. Each pallet 15 has packed therein in upstanding positions cylindrical objects, and for the purpose of description only will be described as drums 16. The size of the pallets 15 is such that the drums 16 are seated thereon in three longitudinal columns of four drums each. The drums 16 are aligned in transverse rows.

In the past, utilizing the conventional method of loading the drums into the trailer 10, a total of 216 drums may be stored and shipped, with the assumption that the drums are packed one high.

Figure 2:
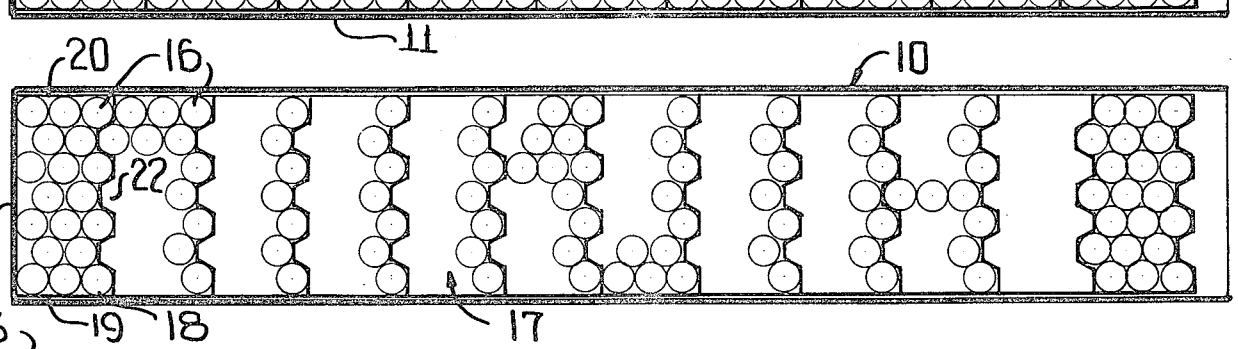
FIG. 2 is a schematic plan view similar to FIG. 1, showing the same cylindrical drums packed inside of the same trailer in accordance with this invention.

Referring now to FIG. 2, it will be seen that the trailer 10 may be loaded with the same drums 16 on a different ype of pallet construction so as to enable one to place 249 of the drums 16 in the trailer 10. This constitutes a gain of 33 drums or an increase on the order of 15%.

In accordance with this invention, in lieu of the customary rectangular pallets 15, special pallets, generally identified by the numeral 17, are provided. Further, a terminal special pallet 18 is also provided.

The illustrated pallets 17 have a width generally corresponding to the width of the trailer inside. However, depending upon the size of the drums, the width of a pallet 17 may be a unit fraction of the permissible inside width of the trailer, i.e. one-half, one-third, etc., of the trailer inside width. This arrangement may be feasible only if the number of columns of drums or other cylindrical objects is readily divisible by a unit number such as 2, 3, etc. In the illustrated size of drum 16, where the drums are arranged in seven columns, this would not be feasible. On the other hand, if the diameter of a drum or other cylindrical object 16 to be loaded would permit eight columns of drums, the pallets 17 could be on the order of one-half the inside width of the trailer.

Figure 3:
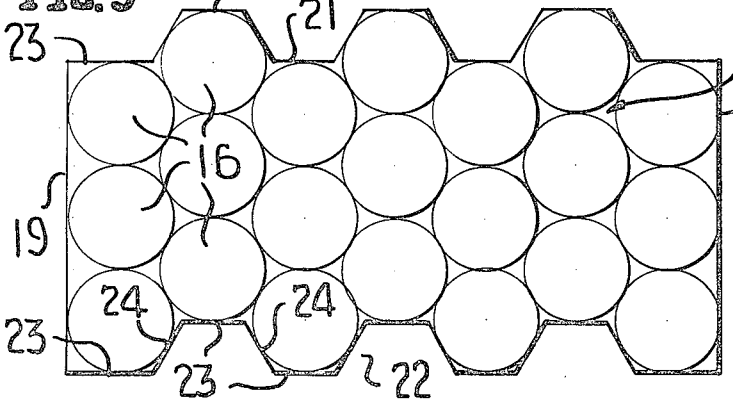
FIG. 3 is an enlarged plan view of a single pallet having positioned thereon cylindrical drums in accordance with this invention.
Figure 4:
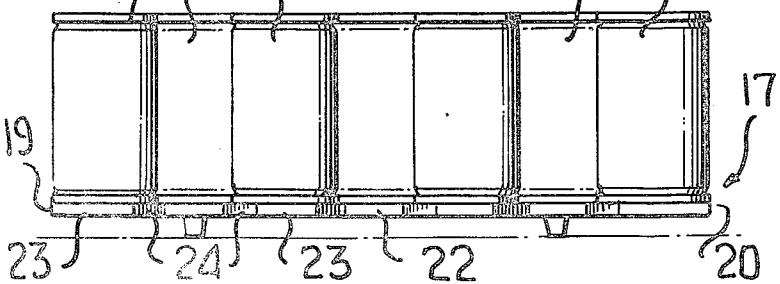
FIG. 4 is an elevational view of the pallet and drum combination of FIG. 3.

Referring now specifically to FIGS. 3 and 4, it will be seen that the pallet 17 has two side edges 19, 20 and two end edges 21, 22. The side edges 19, 20 are disposed parallel to one another and are of a straight line configuration. On the other hand, the ends 21, 22 are of a notched construction and include a plurality of first straight line, transversely extending edges 23 which are transversely interrupted and disposed in transversely alternating, longitudinally offset parallel relation. The straight edge portions 23 are interconnected by diagonal edge portions 24.

It is to be understood that the end edge 21 is complementary to the end edge 22, and that the spacing between longitudinally aligned edge portions 23 at the opposite ends of the pallet 17 will be equal to a unit number of cylindrical objects 16 for which the pallet is intended.

With particular reference to FIG. 4, it will be seen that the drums 16 are illustrated as being arranged one high on the pallet. It is to be understood that depending upon the size of the cylindrical objects or drums and the weight of the product contained therein, the cylindrical objects 16 may be stacked more than one high on the pallet. It is further feasible that the pallets be stacked two high or even higher. This all would depend upon the weight limitations of the filled cylindrical object and the associated trailer. However, the stacking of the cylindrical objects either on the pallet or in layers of pallets in the conventional manner, four such cylindrical objects would in no way vary the increased capacity which, as set forth above, is on the order of 15%.

It is fully appreciated that when cylindrical objects of adjacent rows are longitudinally offset and transversely internested, there will be a certain loss at the front and rear ends of the trailer. However, this slight loss in space, with the long trailer, will be offset by the fact that in the illustrated drum size seven columns of drums can be stacked as opposed to the previously permissible six columns.

In order further to save space, particularly at the forward end of the trailer, there is provided a starter pallet 18. The pallet 18 is identical to the pallet 17 except that it has a straight line forward end edge 25. The side edges 19, 20 and the other end edge 22 will be identical to those of the pallet 17.

With particular reference to FIG. 2, it will be seen that while the pallets 17 will hold twenty-one drums 16, the pallet 18 will hold only eighteen drums 16, as is illustrated.

In FIG. 4, in elevation, the pallet 17 has been illustrated in the form of a solid block. It is to be understood, however, that it is fully appreciated by applicant that the pallet must be of a hollow construction for receiving the fingers or prongs of a forklift truck in order to facilitate the loading and unloading of the trailer with the loaded pallets. The specific constructional details of the pallets 17 and 18 form no part of this invention.

Although only a preferred embodiment of the invention has been specifically illustrated and described herein, it is to be understood that minor variations may be made in the pallet construction and the use thereof to pack a vehicle body with cylindrical articles without departing from the spirit and scope of the invention as defined by the appended claims.

I claim:

1. A pallet particularly adapted for holding plural cylinderical items arranged in adjacent parallel rows with items of adjacent rows being offset in the direction of said row and internested, said pallet having remote sides and ends, said sides extending longitudinally and and continuous in the intended row direction and being parallel, and said ends extending generally transversely of said row direction, at least one of said ends including plural first edge portions disposed in transversely alternating longitudinally offset parallel relation with there being one first edge portion for each intended row, and diagonal second edge portions positioned to bridge adjacent intended rows and joining adjacent ones of said first edge portions.

2. A pallet according to claim 1 wherein said pallet is a terminal pallet and the other of said ends has a continuous straight line edge.

3. A pallet according to claim 1 wherein the other of said ends is complementary to said one end.

4. A pallet according to claim 3 wherein there is a plurality of said pallets in end-to-end interlocking relation.

5. A pallet according to claim 3 wherein there is a plurality of said pallets in end-to-end interlocking relation, and there is a terminal pallet having the other of its ends in the form of a continuous straight line edge.

6. A pallet according to claim 1 wherein cylindrical items are stored on said pallet in adjacent interlocking rows, each cylindrical item being fully on a respective pallet.

7. A method of loading a vehicle with cylindrical items comprising the steps of providing pallets of a width generally corresponding to the internal width of the vehicle divided by a whole number and having notched transversely extending ends each including plural first edge portions disposed in transversely alternating longitudinally offset parallel relation and diagonal second edge portions joining adjacent ones of said first edge portions, stacking the cylindrical items on said pallets in longitudinal rows each aligned with a pallet first edge portion and with items of adjacent rows in longitudinal offset and transversely interlocking relation, each cylindrical item being disposed entirely on a respective pallet, and each diagonal second edge portion extending partially across adjacent ones of said rows, and placing the loaded pallets in the vehicle in end interlocking relation with endmost items of one pallet longitudinally overlapping endmost items of a next adjacent pallet.

8. A method according to claim 7 together with the step of providing a terminal pallet having a straight end and a notched end, stacking cylindrical items on said terminal pallet, and placing the stacked terminal pallet at a starting end of the other pallets.

9. A method according to claim 7 wherein said pallets are of a width generally corresponding to the vehicle internal width.

* * * * *